US008109115B2

(12) United States Patent
Pippia et al.

(10) Patent No.: US 8,109,115 B2
(45) Date of Patent: Feb. 7, 2012

(54) REFRIGERATION APPARATUS FOR COOLING PRESSURIZED BEVERAGES

(75) Inventors: Ennio Pippia, Udine (IT); Deny Longo, Pordenone (IT)

(73) Assignee: Electrolux Professional SpA, Pordenone (IT)

( * ) Notice: Subject to any disclaimer, the term of this patent is extended or adjusted under 35 U.S.C. 154(b) by 510 days.

(21) Appl. No.: 11/460,283

(22) Filed: Jul. 27, 2006

(65) Prior Publication Data

US 2007/0079625 A1 Apr. 12, 2007

(30) Foreign Application Priority Data

Oct. 6, 2005 (IT) ..... PN2005A0069

(51) Int. Cl.
*F25D 25/00* (2006.01)

(52) U.S. Cl. ..... 62/378; 62/336; 62/448; 62/457.4; 62/457.9; 62/498; 222/95; 222/105; 222/146.6; 222/400.7; 222/400.8; 222/401; 222/529; 222/530

(58) Field of Classification Search ..... 62/336, 62/378, 448, 457.4, 457.9, 498; 222/146.6, 222/400.7, 400.8, 401, 95
See application file for complete search history.

(56) References Cited

U.S. PATENT DOCUMENTS

| | | | | |
|---|---|---|---|---|
| 4,640,101 | A * | 2/1987 | Johnson | 62/294 |
| 4,882,910 | A * | 11/1989 | Meehan et al. | 62/256 |
| 5,251,787 | A * | 10/1993 | Simson | 222/95 |
| 6,481,238 | B1 * | 11/2002 | Jennings et al. | 62/457.4 |
| 6,497,343 | B1 * | 12/2002 | Teetsel, III | 222/1 |
| 6,913,167 | B2 * | 7/2005 | Phelps et al. | 222/152 |
| 2002/0050496 | A1 * | 5/2002 | Van Der Meer et al. | 222/105 |
| 2002/0194861 | A1 | 12/2002 | Shin | |
| 2004/0139763 | A1 * | 7/2004 | Jeong et al. | 62/448 |
| 2004/0216474 | A1 * | 11/2004 | Jablonski et al. | 222/146.6 |

FOREIGN PATENT DOCUMENTS

| | | | |
|---|---|---|---|
| CN | 2238242 | Y | 10/1996 |
| CN | 1393671 | A | 1/2003 |
| CN | 1412105 | A | 4/2003 |
| WO | WO 2004/099060 | A2 | 11/2004 |

OTHER PUBLICATIONS

Chinese Office Action dated Oct. 14, 2008 for Application No. CN2006101420710.

* cited by examiner

*Primary Examiner* — Frantz Jules
*Assistant Examiner* — Azim Rahim
(74) *Attorney, Agent, or Firm* — Pearne & Gordon LLP

(57) ABSTRACT

Refrigeration apparatus comprising a cold storage compartment, accessible from the outside, and provided internally with a sealed container adapted to accommodate a flexible and compressible receptacle holding a beverage; there are provided pneumatic or air-compression means to generate a selectively controllable pneumatic pressure inside said container, but outside said flexible receptacle, and said sealed container is capable of being opened from the outside by means of a closure applied on a face thereof, wherein said closure is provided with a through-aperture, through which there extends a drawing-off conduit. Whenever a need arises for beverage to be drawn off the receptacle, a pressure increase is triggered inside the sealed container, and said pressure increase will act upon the walls of the internal receptacle so that the latter is caused to collapse and reduce its volume, thereby causing the beverage to be ejected therefrom and, therefore, drawn off.

7 Claims, 3 Drawing Sheets

REFRIGERATION APPARATUS FOR COOLING PRESSURIZED BEVERAGES

The present invention refers to an improved type of refrigeration apparatus provided with means adapted to accommodate a sealed container, inside which there is arranged a flexible and compressible receptacle containing a beverage. This apparatus is further provided with means adapted to generate an adjustable gas pressure inside said sealed container, wherein such pressure is used to compress said flexible receptacle.

While reference is made to a refrigeration apparatus provided with a single storage compartment throughout the following description, it shall be appreciated that the explanations given in the same description similarly apply to and, therefore, can effectively be used in refrigeration appliances involving several storage compartments at different temperatures, such as for instance so-called refrigerator-freezer combinations.

In commercial foodservice and mass catering operations, restaurants, public houses and places of refreshment in general, a really large use is regularly made of beverages, which—owing to both economical and space-usage reasons, as well as to reasons of convenience in handling them—cannot in all cases be stored in small containers or bottles. Use is made therefore of large-capacity containers, from which the requested beverages are each time poured out.

However, these large-capacity containers are of course quite awkward to handle, and this is also the reason why their use is not so widespread.

A typical case in which use is currently made of such large-capacity containers is represented by beer counters and beer houses in general. Beer is transported to and generally also stored and kept at the points of service in large containers, in which an overpressure is created artificially in order to enable the same beverage to be readily and conveniently poured out on request, by also causing said beverage to rise up from levels below the tapping point. This practice—which is widely known in the art and does certainly not need any further explanation to be given here—is anyway being increasingly used also in the sector of soft drinks and beverages in general.

It should however be duly noticed that the use of large rigid containers, which are in most cases made of metal, and are furthermore regularly recovered for re-use, is connected with a number of even quite serious drawbacks, as they are clearly set forth and described in the first two pages of the patent application WO 2004/099060 to CARLSBERG BREWERIES, to which reference should also be made for reasons of brevity.

In order to do away with such drawbacks, the above-cited patent document discloses a solution consisting in making use of non-rigid, but rather flexible containers of a low-cost kind for use as one-way, i.e. disposable containers. These flexible containers are caused to deliver the beverage contained therein by having resort to an innovatory method based on creating an overpressure not inside the containers themselves, but on the outside thereof. This overpressure, by acting upon the flexible walls of such containers, compresses them in a controlled manner, thereby reducing their volume and causing them to gradually collapse.

The inner pressure that is in this way generated inside said containers is then effective in enabling the beverage to be drawn, i.e. poured out as desired.

These containers typically consist of large bottles or jars of plastic material, such as in particular PET, which are manufactured using a technique that is quite similar to the one used to produce the bottles as commonly and widely used nowadays for distributing table water and other carbonated or soft beverages in general. As widely known in the art, such bottles are quite low-cost, very light, and most easily and readily recyclable; they allow the beverages contained therein to be most effectively and safely stored and preserved in the short-to-medium term and, while generally ensuring an adequate extent of robustness and rigidity, when adequately compressed they readily transfer the so applied pressure to their interior and their volume can be reduced by many times.

A further basic advantage of these PET containers lies in the fact that, even in the case that they are contracted and reduce their volume, they anyway keep retaining a sufficient elasticity and do not rupture, so that their walls remain sealed, i.e. fluid-tight, following at least the first volume contraction. This peculiarity, therefore, makes them suitable for use in the above-described applications, since they—owing to them being used only once and then disposed of—enable the beverage contained therein to be kept and preserved there through a number of subsequent draughts, until they eventually are fully emptied.

Such improved way of transporting and distributing the beverages, however, comes into collision with a major, albeit easily imaginable drawback that consumers generally tend to perceive as most disagreeable. In other words, the beverages being held in such large flexible containers are not cooled and, as a result, are stored and distributed, i.e. served at room temperature. This circumstance turns out as being particularly unfavourable not only in the case of a number of types of beverages, such as beer and the like, but also in general during summer or hot-weather periods of time, when cooled beverages are particularly high in demand.

There is furthermore a health-related aspect to be duly taken into account: in fact, if these beverages are stored and kept in an ambient in which the temperature is not low enough, the risk of a bacteriological and organoleptic deterioration thereof increases to a considerable extent.

In view of overcoming these drawbacks, it would most obviously be quite appropriate and advantageous for such containers—accommodating said flexible containers or receptacles thereinside—to be capable of being introduced and stored in common-kind refrigeration appliances. These appliances would of course have to be appropriately adapted to fit such intended use thereof and, specifically, they must enable the conduits needed for pressurizing and de-pressurizing the interior of the container to be properly led into the appliance and outside, respectively, unless it is selected for the pressurizing means to be directly arranged in the cool storage compartment (thereby creating, however, a number of still more serious problems and complications to be overcome).

In addition, said containers would have to be arranged so as to have the delivery mouth or spout thereof located downwards, i.e. at a low level, in much the same way as described in the afore-cited prior patent, and this circumstance would again involve further complications from both a construction and operation point of view.

An additional complication derives from the need for an adequate space to be found and made available inside the cabinet of a refrigeration appliance, for the afore-described pneumatic compression means to be then installed there.

A further problem arises from the need for not only the container whose receptacle containing the beverage is already connected outside, but also an additional receptacle filled with beverage and kept in reserve to be accommodated inside a single and same refrigeration compartment, so that when the first receptacle is eventually emptied, it can be replaced with another one that is already cooled down; such need must also come to terms with the need for said containers/receptacles to have an adequately large volume, i.e. a capacity that is not too small, in order to avoid having to replace a just emptied receptacle with a full one too frequently.

In general, it may be stated that a simple utilization of a refrigeration appliance of a common and current kind that has undergone a minimum extent of simple internal adaptations in view of being able to accommodate said container, is far from being satisfactory in solving all of the above-indicated problems.

It would therefore be desirable, and it is actually a main object of the present invention, to provide a refrigeration apparatus, in which the containers holding said beverage-filled receptacles are capable of being appropriately accommodated, and in which said containers are adapted to allow the beverages to be draught in a convenient, most easy manner without the container having to substantially be extracted or removed from the refrigeration apparatus itself.

More generally, it is a purpose of the present invention to provide a refrigeration apparatus that is designed and made so as to optimise both the storage and use conditions of a container, inside which there is arranged a beverage-filled receptacle, and the replacement of such receptacle, while simplifying and optimising handling of the container and, in general, controlling the whole operation of the refrigeration apparatus.

These aims, along with other features of the present invention that will be described further on, are reached in a refrigeration apparatus made and operating as recited in the appended claims. Features and advantages of the present invention will anyway be more readily and clearly understood from the description that is given below by way of non-limiting example with reference to the accompanying drawings, in which:

Figure 1:
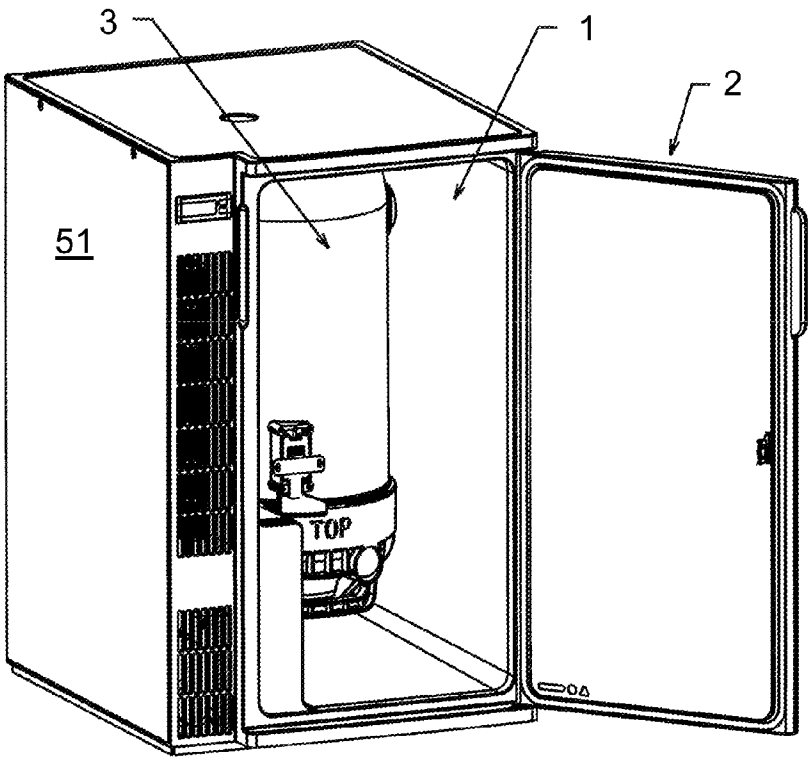
FIG. 1 is a perspective front view of a refrigeration apparatus according to the present invention.
Figure 2:
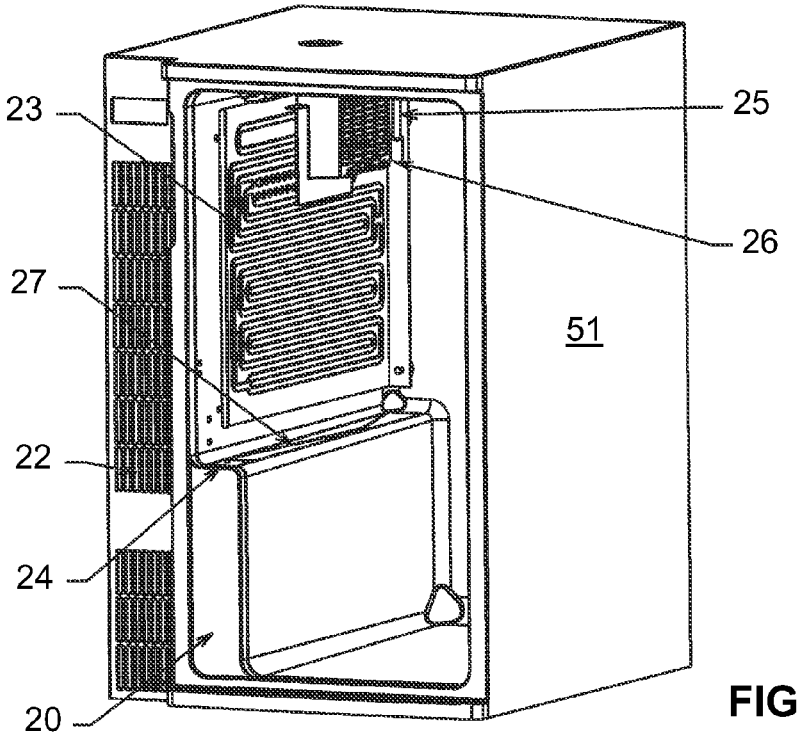
FIG. 2 is a corresponding view of the refrigeration apparatus of FIG. 1, in a state in which a wall thereof is removed.
Figure 3:
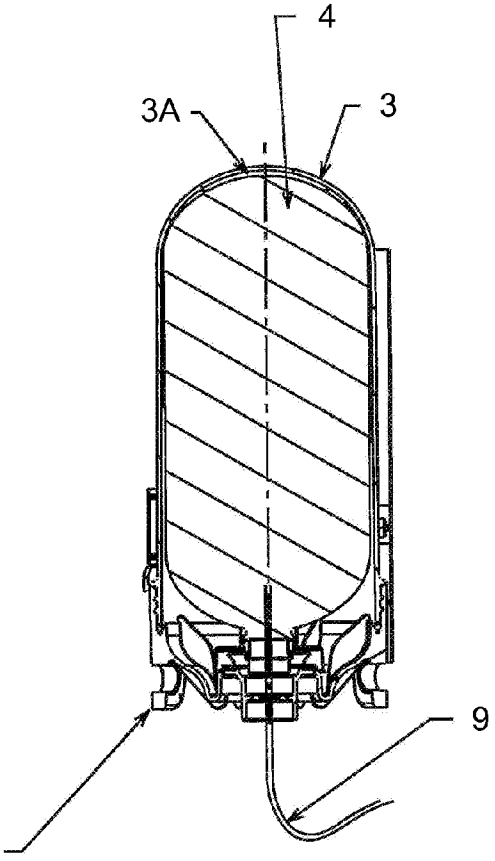
FIG. 3 is a symbolical, schematical cross-sectional view of the basic component parts of the apparatus according to the present invention.

With reference to FIGS. 1, 2 and 3, use is made basically of a prior-art refrigeration apparatus, i.e. a refrigeration apparatus as widely known as such in the art comprising a cold storage compartment 1 that is accessible from the outside through a normal door 2. In this cold storage room 1 there is arranged a sealed container 3, of a type generally known as such in the art, e.g. as described in the afore-cited patent to CARLSBERG, adapted to accommodate in its internal volume 3A (see FIGS. 2 and 3) a flexible and compressible receptacle 4, in which there is contained the beverage to be cooled and drawn.

Said receptacle 4 is normally closed by a plug 15, through which there is capable to pass—in a fluid-tight manner relative to the same plug—a draught conduit 9 to pour out the beverage.

Even said sealed container 3 is provided—on a face thereof—with a respective sealed cover 31 that is capable of being removed in view of introducing said receptacle 4 there-into. Furthermore, even this cover 31 is provided with a through-bore for said draught conduit 9 to be able to pass therethrough, thereby establishing a communication between the interior of the receptacle, i.e. the beverage, and the draught device provided on the exterior for said beverage to be poured out.

Said refrigeration apparatus is also provided with an air compressor 6, adapted to compress the ambient air to generate a pressure above the atmospheric one, and a so-called pressurizing conduit 5, which connects the delivery side of said air compressor with the interior volume of said container 3.

The air compressor 6 is provided with control means of a basically conventional type and, in particular, it is provided with a control device 17 adapted to automatically and continuously detect—via an appropriate sensor 16—the pressure existing in the pressurized circuit, i.e. the pressure prevailing in the interior volume 3A of the container 3, and to maintain such pressure at a pre-established value, i.e. at a value that is adequate in view of compressing said receptacle 4 and causing it to contract whenever part of the beverage contained therein has to be drawn off.

Basically, this air compressor 6 keeps said receptacle 4 under a constant pressure, wherein no beverage can flow out of the same receptacle when said draught conduit is kept closed. When the draught conduit is on the contrary opened, the existing pressure causes the beverage to flow out and, therefore, be drawn, so that the receptacle itself reduces its volume correspondingly; this also causes the pressure within the container 3 to decrease and this reduction in the internal pressure is immediately detected by said sensor and, as a result, said pressure control means, which in turn immediately activate the compressor that keeps operating until a minimum pre-determined value is re-established in the container.

Figure 4:
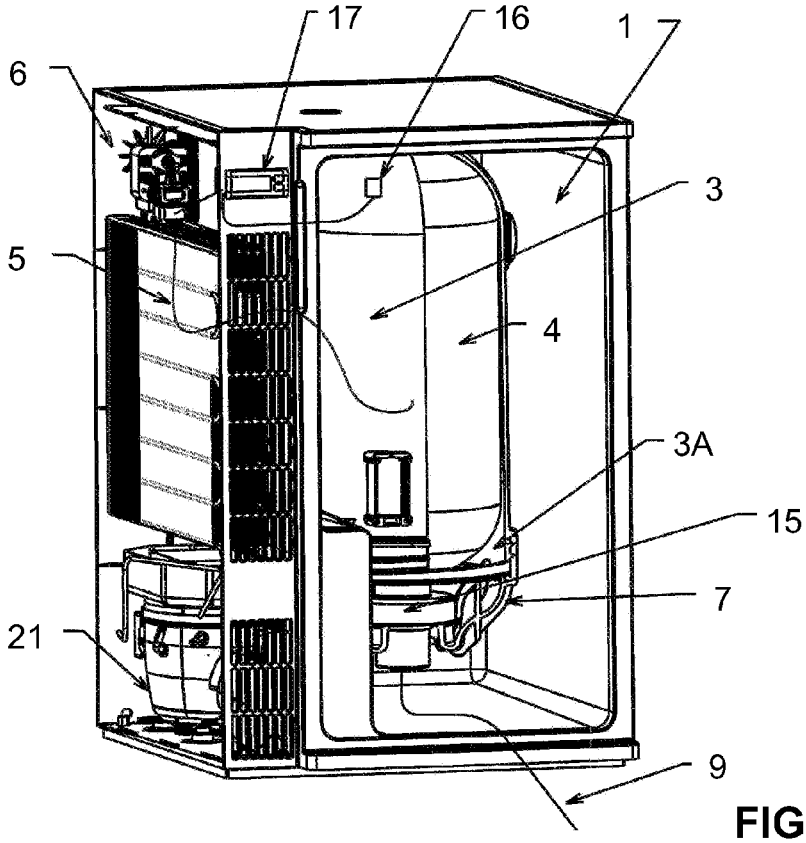
FIG. 4 is a perspective view of the refrigeration apparatus shown in FIG. 1, as viewed from a different point.

With reference to FIGS. 1, 2 and 4, it can be noticed that the interior of said storage compartment 1 is provided with a recess 20, i.e. a recessed space arranged on the lower portion of a side wall thereof.

Furthermore, on the same side of the outer casing 51 of the apparatus, and facing outwards, there is provided an accommodation 22 having substantially the same height and the same depth as the apparatus itself, and wide enough to be able to contain both the refrigerating unit and the air compression unit.

As a result, the lower portion turns out as being wider than the upper portion, since to the width of said accommodation there must be added the width of said adjacent recess, which it advantageously joins to.

In fact, the real advantage derives in this case from the fact that the compressor 21, which is usually the largest component part in a refrigeration appliance, can be most conveniently arranged in said larger-sized lower portion, without giving rise to any collateral problem as far as the accommodation and installation of the other component parts are concerned.

In this manner, the height of the cold storage compartment 1 is just slightly smaller than the height of the outer casing 51 of the apparatus, thus allowing for the accommodation of as high as possible a container 3, consistently with the height of the storage compartment itself. Since the container has such a considerable height, it is able to also ensure—for a same cross-section area—a greater beverage holding capacity and, therefore, may be provided with a fairly limited cross-section area, while being still able to contain a sufficient quantity of beverage, without however, preventing it—when installed in an upright position—from allowing also a reserve beverage receptacle to be duly accommodated close to it inside said storage compartment.

The advantage offered by this solution lies in the fact that such reserve beverage receptacle may therefore be kept stored in a cooled state for immediate installation in the container as a replacement for the receptacle in use there as soon as the latter runs dry, i.e. is exhausted.

The above-described solution allows for a further advantageous improvement; in fact, with reference to FIG. 4, the evaporator 23—which is made according to the largely known "roll bond" technology—is arranged sideways vertically on a side wall of the cold storage compartment and, in particular, it is arranged exactly above the small step-like configuration 24 that of course forms above said recess 20. It will be most readily appreciated that such arrangement enables the evaporator to be positioned so that it will not take up any useful space inside the cold storage compartment, since the zone located above said step-like configuration 24 cannot anyway be used up by either the container or the reserve beverage receptacle.

Briefly, a perfect synergy is obtained between the dimensions of the container, the dimensions of the cold storage compartment and the dimensions of the outer casing 51 of the refrigeration apparatus, and the positioning of the various component parts, since:

- the compressor, i.e. the largest component part, is accommodated without any problem in the lower zone of the accommodation 22, without putting any excessive penalty on the internal volume of the cold storage room,
- even with the compressor placed on a side downwards, two beverage receptacles can still be accommodated inside the cold storage compartment at the same time,
- said receptacles can still be fully adequate in the beverage holding capacity thereof, owing to them being almost as high as the outer casing 51 of the refrigeration apparatus,
- the evaporator is installed without it taking up any useful space inside the cold storage compartment.

In addition thereto, the presence of said evaporator 23 and the step-like configuration 24 therebelow allows for a still further advantageous improvement, which consists in having a pan 27 resting on said step-like configuration for collecting condensation water dripping from said evaporator.

Another improvement may be easily brought about as follows: since the pneumatic means used to compress the air inside the container 3 must necessarily include an intake or suction mouth, in the current practice it may well occur that following drawbacks are generated by such circumstance:

- excessive noise generated by the air being taken in,
- possibility for not adequately clean air to be taken in, and
- possibility for moisture-laden air to be taken in (as this is typically present inside public premises).

As anyone skilled in the art will readily appreciate, these are facts that can affect the operation of the pneumatic air-compression means, which typically comprise an air pump.

In order to do away with such drawbacks, there is provided a pipe 25 that is connected with an end thereof to said pneumatic means and is arranged with the other end 26 thereof inside said cold storage compartment 1; in this way, the noise that may possibly be generated will be greatly deadened by the insulation wrapping said compartment 1, whereas the intake air will usually be drier than ambient air.

Typically, the afore-mentioned container 3 has an elongated shape, fully similar to the shape of the beverage receptacle 4 it accommodates, and therefore is in a shape resembling a cylinder, so as to enable the beverage holding receptacles to be easily and conveniently introduced therein. In addition, said cover 31 practically coincides with a base of said cylindrically shaped container 3.

Figure 5:
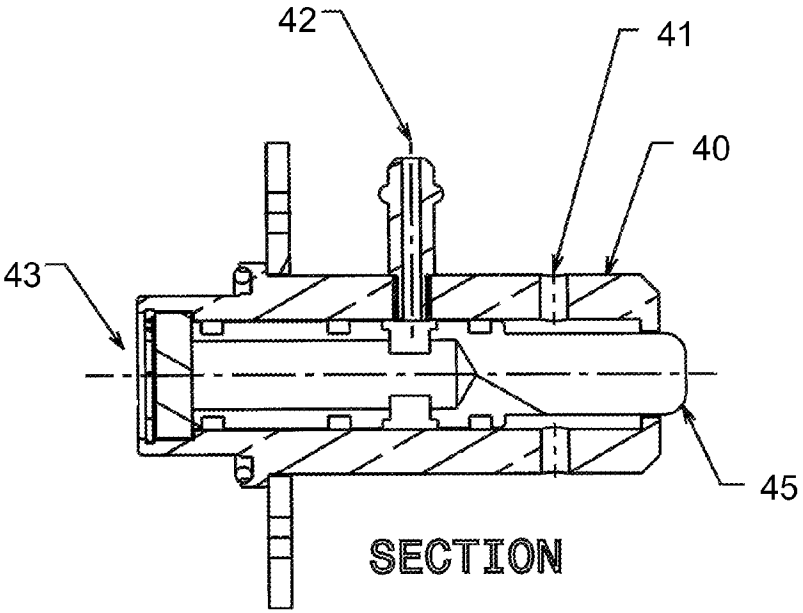
FIG. 5 is a symbolical cross-sectional view of a device comprised in the apparatus according to the present invention.
Figure 6:
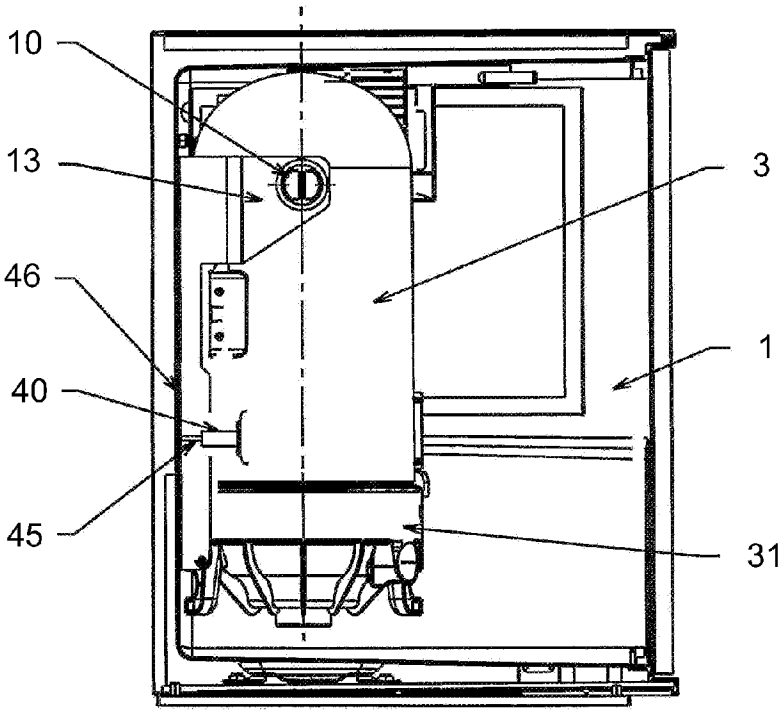
FIG. 6 is a side see-through view illustrating the way in which the device shown in FIG. 5 is installed.

The provision of such pivotally orientable container allows for an advantageous improvement to be implemented in the operation thereof: in fact, with reference to FIGS. 5 and 6, inside the cold storage compartment 1 there is arranged a three-way valve 40, which is provided with a first way 41, a second way 42 and a third way 43.

The first way 41 is connected to the inside of the cold storage compartment 1, the second way 42 is connected to said pneumatic, i.e. air compression means, and the third way 43 is connected to the internal volume of the container 3.

The arrangement of this valve 40 is such that it can be switched into two operating states, i.e. a first state in which the third way 43 is connected to said second way 42, whereas the first way 41 is closed, wherein this first state most obviously corresponds to the compression, i.e. pressurizing phase of the internal volume of the container 3, and a second state in which it is said first way 41 that is connected to said third way 43 to create the condition for the pressure to be released from the internal volume of the container.

The valve will be switched into these two states automatically depending on the instant position and condition of the container, so as to enable the proper operation and handling to take place or to be performed consistently with the actual position and condition of the container. In other words, in the first switching state of said valve, the refrigeration apparatus is closed and operating regularly, with the pneumatic means pressurizing the internal volume of the container, whereas in the second switching state of said valve the pneumatic means are cut off and the compressed air is released from the interior of the container 3 into the cold storage compartment 1.

In order to determine this mode of operation of said valve 40 in an automatic manner, the latter is located in an appropriate position on the outside of said container 3 and is provided with an actuating arm 45 for opening and closing said three ways thereof.

The positioning of the valve, the orientation of said actuating arm thereof and, of course, the general geometries and dimensions shall in this case be selected so as to ensure that, when the container 3 is closed and operating, i.e. when it is lowered into working position, the actuating arm 45 of the valve 40 is pushed, and therefore actuated, by its interfering with a specific zone or portion 46 of the wall, in particular of the back wall of the cold storage compartment, as illustrated in FIG. 5, and the valve automatically switches into said first operating state thereof that corresponds exactly to said mode of operation of the refrigeration apparatus and the container installed thereinside.

When the need on the contrary arises for an exhausted beverage receptacle to be replaced in said container, the container 3 must be rotated and raised, thereby causing the actuating arm 45 to be released by a spring (not shown); this again causes said valve 40 to be actuated to switch into said second state thereof, in which the pressure is released from the interior of the container, i.e. a state that is exactly consistent with the rotated and raised position of the same container.

The invention claimed is:

1. Refrigeration apparatus comprising:

a cold storage compartment (1), accessible from the outside through a door (2), and provided internally with a sealed container (3) adapted to accommodate a flexible and compressible receptacle (4) suitable to contain a beverage, pneumatic or air compression means (6) to generate a selectively controllable pressure between said container (3) and said receptacle (4), in order to compress the receptacle (4), thus causing the beverage to draw off, refrigerating means to pull down the temperature inside said cold storage compartment, comprising a compressor (21) and an evaporator (23), a control panel to control the temperature-related and pressure-related operation of said refrigeration apparatus from the outside, said pneumatic means, said refrigerating means and said control panel being arranged on a side portion (22) of said refrigeration apparatus, said evaporator (23) being arranged vertically along a wall of said cold storage compartment, said cold storage compartment being provided internally with a recessed portion (20) extending in its lower portion, and sideways relative to said compartment, said compressor (21) being arranged in said recessed portion (20), said evaporator (23) being positioned above said recessed portion (20).

2. Refrigeration apparatus according to claim 1, wherein said side portion extends to substantially cover the entire height of an outer casing of said refrigeration apparatus.

3. Refrigeration apparatus according to claim 1 or 2, wherein on the upper surface of said recessed portion there are provided means (27) adapted to collect condensation water dripping from said evaporator.

4. Refrigeration apparatus according to claim 1, wherein said pneumatic means comprise an air intake mouth (26), in which said intake mouth is located inside said cold storage compartment (1), and an appropriate conduit (25) connecting said mouth (26) to said pneumatic means.

5. Refrigeration apparatus according to claim 1, wherein said pneumatic means comprise a three-way valve (40), of which a first way (41) is connectable with the inside ambient of said cold storage compartment, a second way (42) is connectable with said pneumatic means, and a third way (43) is connectable with the internal volume of said sealed container (3).

6. Refrigeration apparatus according to claim 3, wherein a three-way valve (40) is mechanically actuatable into two switching states thereof, depending on the position taken by said sealed container (3) inside said cold storage compartment, wherein in a first such switching state said third way (43) is connected to said second way (42), and wherein in a second such switching state said first way (41) is connected to said third way (43).

7. Refrigeration apparatus according to claim 4, wherein a three-way valve (40) is provided with an actuating arm (45) adapted to be actuated by its entering into contact with/separating from a specific zone (46) of a back wall of said cold storage compartment (1).

* * * * *